United States Patent [19]

Spengler

[11] Patent Number: 4,563,977

[45] Date of Patent: Jan. 14, 1986

[54] ELECTROSTATIC COATING PLANT

[76] Inventor: Walter Spengler, Strehlgasse 23, CH-4105 Biel-Benken, Switzerland

[21] Appl. No.: 645,543

[22] Filed: Aug. 28, 1984

[30] Foreign Application Priority Data

Aug. 29, 1983 [CH] Switzerland ..... 4727/83

[51] Int. Cl.[4] ..... B05D 1/04

[52] U.S. Cl. ..... 118/623; 118/634; 118/635; 118/638

[58] Field of Search ..... 118/623, 634, 635, 638

[56] References Cited

U.S. PATENT DOCUMENTS

| | | | |
|---|---|---|---|
| 2,428,991 | 10/1947 | Ransburg | 118/635 |
| 2,729,191 | 1/1956 | Ransburg | 118/635 |
| 2,730,988 | 1/1956 | Starkey | 118/635 |
| 3,976,031 | 8/1976 | Itoh | 118/634 |
| 4,230,068 | 10/1980 | Itoh et al. | 118/634 |

*Primary Examiner*—Richard Bueker

*Attorney, Agent, or Firm*—Bell, Seltzer, Park & Gibson

[57] ABSTRACT

Inside the enclosing wall (1) of the electrostatic coating plant for applying dry or wet color coatings to electrically conductive surfaces of articles (2) set up in an insulated position is located an electrostatically chargeable curtain (9), the charge polarity of which is the same as that of the spraying gun (7) used for the coating operation. The article (2) set up in an insulated position is supplied with opposite polarity, which is necessary for the electrostatic coating, by an inductor arrangement (16) arranged above the article (2), the inductor arrangement (16) applying an electrostatic field produced by means of a peak inductor (19) to an electrically conducting layer (18), which is located on the rear of a casing piece (17) made of insulating material. The charge field radiated from the surface of the casing piece (17) brings the article (2) to be coated, suspended beneath the casing piece (17), to a potential at which the material particles located in the spraying jet (8) of the spraying gun (7) strike both the front and rear surface sections with approximately uniform distribution.

The achieved electrostatic guidance of the coating material particles enables both an optimum utilization of the coating material and a speeded-up operating function of the coating plant.

11 Claims, 2 Drawing Figures

ELECTROSTATIC COATING PLANT

Figure 1:
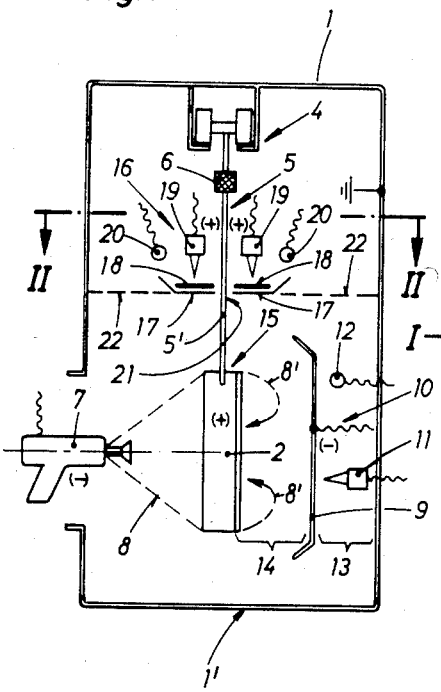

The present invention relates to an electrostatic coating plant according.

It is known to provide electrically conducting articles, which are suspended on a fixed, grounded suspension device or on a grounded conveyor chain, with a powder or wet coating, for example in the form of a color application, by means of an electrostatic gun. To achieve a regular application of coating material also on the side of the articles facing away from the gun, it is of considerable importance that, apart from the generation of an electrostatic field exactly adapted (strength and field orientation) to the article to be coated, the locally accumulating quantity of coating material (distribution of the material in the application cloud) is also exactly adjusted specifically to the article. Of significantly greater importance still, however, is that the grounding of the article or its connection to an opposite pole to that of the gun potential is faultless and always constant. This especially applies to coating plant with continuous flow of the articles to be treated, where inspecting the ground contact points, which are normally located in the area of the blown-in cloud of coating material, is made difficult or is practically impossible. After a short time, this results in applied coatings of such a thickness that, especially in the case of powder coatings, they lead to insulating effects even under high operating or charge voltages; moreover, unwanted deposits follow from this even under normal operation as a consequence of uncontrollable stray electric fields and defective guidance of the coating material or the proportion of material in excess quantity, and these deposits can only be removed poorly or with a considerable outlay in terms of time and/or equipment. In any case, costs accrue from this for expenditure on material, cleaning and maintenance, which lie in a noticeably poor relationship compared with the component being treated.

All of the above statements also apply when, namely, the articles to be coated, insulatingly suspended, come within the working range of the electrostatic gun, and the individual articles, as already practiced according to the prior art, are grounded near the article which has just been treated.

The aim of the present invention is therefore to create an electrostatic coating plant, by means of which the disadvantages described can be avoided, and in particular the problem of reliably grounding the articles to be coated can be satisfactorily solved. From this it should be possible to derive better utilization of both dry (powder) and wet (paint) coating material. It should likewise be possible to obtain a more uniform and "holefree" covering coating by an improved "encompassing" of the cloud of coating material.

According to the invention the object is achieved by an electrostatic coating plant comprising an enclosing wall defining an enclosed treatment area, a spraying gun for spraying electrostatically charged particles of a predetermined polarity into the treatment area, a support device electrically insulated from said enclosing wall for supporting an article to be coated in said treatment area within the spraying range of said gun, inductor means cooperating with said support device for charging the article which is supported thereon with an electrostatic potential of a polarity opposite that of the electrostatically charged particles from said spraying gun, at least one electrically conducting curtain electrically insulated from said enclosing wall and positioned in said treatment area opposite said spraying gun and behind the article to be coated, and means for charging said at least one curtain with an electrostatic potential of the same polarity as the electrostatically charged particles from said spraying gun, whereby particles which may be sprayed past the article are reflected back onto the rear side of the article. Embodiment forms of the electrostatic coating plant according to the invention follow from the dependent claims.

Apart from the improvements over the prior art which have already been described, special advantages of the invention are that the local build-up of zones acting like Faraday cages can be prevented by an at least partially "open" design of the charge-generating and discharging components. The coating material mist is safely reflected onto the article by the homopolar charge field which is also in the "shadow zone" behind the article, opposite the gun nozzle, thus resulting in a coating booth which is clean or which can be easily kept clean. The field-emitting inductor and ionizing devices, which can be optimally controlled by field strength sensors, enable a largely automized and consequently personnel-economizing operation. The work variables which can be optimized in a simple way enable in many cases the material throughput to be increased and consequently the efficiency of the plant to be optimally increased.

The inventive subject is described by way of example as follows with reference to a schematic representation of a cross-sectional view (FIG. 1) and a plan view (FIG. 2) along plane II—II according to FIG. 1.

Figure 2:
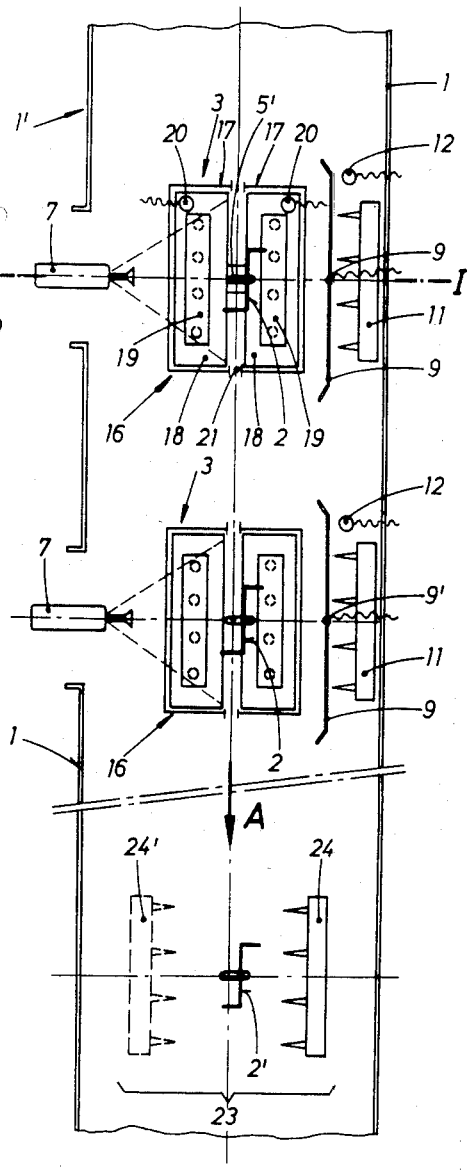

The drawing shows the enclosing wall 1 of a continuous channel or a coating booth for the continuous or gradual feed of articles 2 to be treated which are metallic or are provided with an electrically conducting surface, the form and size of the articles 2 in no way being restricted to the illustrated example. Moreover, the number of working or coating areas 3 shown in FIG. 2 is not essential to the invention. On the contrary, especially for continuous operation, only one working area 3, as opposed to more than two working areas 3 for non-continuous operation, need be available.

FIG. 1 shows a conveying device 4, designed for mechanically feeding the article 2 to be coated, with a suspension support 5, the lower section 5' of which supporting the article 2 is electrically separated by an insulating member 6 from the conveying device grounded together with the enclosing wall 1 of the continuous channel. For coating larger articles or objects, such as, for example, car bodies or steel furniture, the conveying device can be supported on the ground and designed as an insulatingly arranged conveyor belt. An electrostatic coating material spraying gun 7 is located opposite the article 2 to be treated in such a way that its spraying jet 8 is able to reach a desired, adjustable area of the article 2. The gun 7 can be arranged so that it can be moved in the horizontal and vertical direction, and in the forward and return direction, for coating articles 2 whose size extends beyond the range of the spraying cone 8.

An electrostatic curtain 9 is attached opposite the article 2 relative to the working area of the gun 7, the surface of the electrostatic curtain 9 extending at least over this working area. The contour of the curtain is advantageously selected in such a way that the rear of the article 2 is optimally provided with coating material particles from the spraying jet 8. The curtain 9 can be extended toward both the upper and the lower side of the article, preferably with separate-booth plant, but also for plant with continuous or gradual throughput.

The curtain 9 is impermeable to the coating material and possesses at least on its rear side an electrically conductive layer to which a potential of the same polarity as at the gun 7 can be applied. In view of the fact that the gun 7 (depending on the prevailing operating conditions or better coatability of the article 2) can be optionally biased negatively or positively, the polarity of the curtain 9 can consequently be reversed. Providing the curtain 9 with the same polarity as that of the gun 7 ensures that coating material sprayed by the spraying jet 8 and reaching behind the article is not deposited on the curtain 9 but is reflected (arrow 8' shown by broken line) against the rear side of the article 2. The latter, as explained below, is at a potential of the opposite polarity to that of the gun 7. For explanation purposes, it is here assumed that the gun potential is negative and the article potential positive.

The potential of the curtain can be optionally applied via a resistive connection 10 or contact-less by means of a peak inductor device 11, the discharging peaks 11' of which are facing toward the rear of the curtain 9. The latter method of feeding is advisable if there are problems of protection against accidental contact. Because variously high potentials can exist at the gun 7 and curtain 9 during operation, an appropriate voltage-regulating device (not shown), if necessary controlled by a sensor 12, is available.

The curtain 9 effectively prevents deposits of coating material from forming in the channel section 13 between the curtain 9 and the enclosing wall 1. The surface of the curtain 9 facing toward the article 2 to be coated can be provided with an electrically insulating, interchangeable surface covering, onto which, if need be, coating material particles passing through the particle reflection space 14 can be deposited.

An inductor arrangement 16, which is arranged above the suspension location 15 of the article 2 and, if need be, separately constructed from the lower support section 5 insulated against ground, is available for applying the potential of reversed polarity to the gun 7 and the curtain 9. The potential of reversed polarity can also be, for example, the ground potential. The inductor arrangement 16' is shown in FIG. 1 as halves designed as mirror images relative to the insulated support section 5'. Each of these halves possesses an approximately half-shell like, underlying, electrically insulating casing piece 17, which is adapted to the size of the article 2 to be coated, and which is designed for centrally accommodating an electrically conducting layer 18, of example a strip of metal sheet. A peak inductor 19 is located opposite each of the layers 18, the peak inductor 19 being used for the contactless charging of the respective layer 18. Each half of the peak inductor arrangement 16 can be operated independently and optionally switched on or off. The parts of the inductor arrangement 16 supply the electrostatic opposite field for the article 2 suspended underneath and which is metallic or is provided with an electrically conducting surface. The field strength (and polarity) of the halves of the inductor arrangement 16 can be monitored by sensors 20 and determined by a control device (not shown).

The casing piece 17 can optionally be made of a conducting material, which can be provided with an insulating surface coating for the purposes of protection against accidental contact.

The inductor arrangement 16, as a circuit, can also be at ground potential.

The peak inductor arrangement 16, or respectively one or both of the halves thereof shown as mirror images, can be designed as a fixed device, which extends over one or several areas of coating. At the same time, the suspension support 5' moves in a separation gap 21 between each of the halves to avoid contact with the latter. Each of the halves of 16 is then supported and electrically insulated at the enclosing wall 1 of the continuous channel by support arrangements 22 (not shown in FIG. 2) shown as a broken line. Alternatively, each of the lower sections 5' of the suspension support 5 intended for accommodating an article 2 to be coated can be provided on one side or both sides with an electrically insulating casing piece 17, which essentially extends over the plan area of an individual article 2, and into which is placed a layer 18. However, the peak inductors 19, to be arranged on one side or both sides of the separation gap 21 for the support passage, and the sensors 20 are expediently aligned with the respective coating area and firmly connected to the channel wall 1.

Although the casing pieces 17 made of electrically insulating material are charged in operation at a potential polarity opposite to the polarity of the spraying jet, there is a very low tendency at their lower side to pick up coating material, because the underlying article 2 directly struck by the spraying jet 8 has the same polarity. Moreover, the particles present in the spraying jet 8 are distinctly directed toward the article 2, which is at a potential of opposite polarity, by the curtain 9 located at the rear of the article 2. There is therefore a very low tendency to deposit coating particles even at the channel or booth parts in the channel area above the suspension point 15 of the article 2. A coating plant designed according to the invention can therefore be operated very economically both with regard to the useful material usage and the maintenance and cleaning outlay.

If it is taken into account in FIG. 2 that the throughput direction of the articles 2 to be coated is in the direction of arrow A in the bottom half of the figure, then a coated article 2' passes another ionizing device 23 after the operation is complete and before or after leaving the coating channel, the ionizing device 23 being provided with one or two peak ionizers 24, 24', which bleeds off or neutralizes a charge which is possibly still present on the surface of the coated article 2. Alternatively, the inductor devices 11 and 19 can also be connected as ionizing devices by means of switches (not shown) after the coating operation is complete in order to remove residual charges from the coated articles 2, 2'.

Concerning practical information on the operation of a coating plant of the described type: the potential at the spraying gun 7 is between 50–150 kV and expediently has negative polarity. The potential of the curtain 9 or inductor device 11, monitored by the sensors 12 and controlled as much as necessary, is at about the same level as the gun potential and has the same polarity as the latter. The potential at the inductors 19 of the inductor arrangement 16 or at the surface of the casing pieces 17 can be adjusted manually or by means of sensor control in the range between about 5–30 kV and has positive polarity. The inductor arrangement 16 can also be at ground potential. The voltage at the gun 7 is preset to the value required for optimum performance, as, too, is the voltage at the inductors 19. Adjustments in potential required during operation at the curtain 9 and at the casing pieces can be controlled by sensors.

I claim:

1. An electrostatic coating plant for applying dry or wet surface coatings to articles having an electrically conducting surface, said apparatus comprising an enclosing wall defining an enclosed treatment area, a spraying gun for spraying electrostatically charged particles of a predetermined polarity into the treatment area, a support device electrically insulated from said enclosing wall for supporting an article to be coated in said treatment area within the spraying range of said gun, inductor means cooperating with said support device for charging the article which is supported thereon with an electrostatic potential of a polarity opposite that of the electrostatically charged particles from said spraying gun, at least one electrically conducting curtain electrically insulated from said enclosing wall and positioned in said treatment area opposite said spraying gun and behind the article to be coated, and means for charging said at least one curtain with an electrostatic potential of the same polarity as the electrostatically charged particles from said spraying gun, whereby particles which may be sprayed past the article are reflected back onto the rear side of the article.

2. Electrostatic coating plant as claimed in claim 1 wherein said inductor means is located substantially directly above the article which is supported by said support device.

3. Electrostatic coating plant as claimed in claim 1, wherein said at least one curtain contains a material which is impenetrable to the particles emerging from the spraying gun, and at least the surface facing toward the article to be coated is provided with an electrically insulating material as a protection against accidental contact.

4. Electrostatic coating plant as claimed in claim 1, wherein said at least one curtain is of such dimensions and so positioned relative to said spraying gun as to extend at least over the working area of said gun.

5. Electrostatic coating plant as claimed in claim 1, wherein the electrically conducting material of said at least one curtain is connected to a voltage via a resistive contact.

6. Electrostatic coating plant as claimed in claim 1, wherein said means for charging said at least one curtain comprises an inductor device having discharging peaks facing toward but out of electrically conducting contact with said at least one curtain.

7. Electrostatic coating plant as claimed in claim 1, wherein said at least one curtain is provided with a sensor which monitors the charge field strength delivered by the curtain.

8. Electrostatic coating plant as claimed in claim 2, wherein the inductor means above the article to be coated has a casing facing toward the article to be coated, with an electrically insulating coating applied to at least the surface directed downstream, and an electrically conducting layer carried by said casing.

9. Electrostatic coating plant as claimed in claim 8, wherein the inductor means is divided into two halves located on opposite sides of the support device and symmetrical relative to the support device each of the two halves including an inductor having a discharging peak.

10. Electrostatic coating plant as claimed in claim 8, wherein the inductor means has a one-piece casing firmly connected to the support device, the casing having an electrically through-connecting, conducting layer and a peak inductor electrostatically charging the said layer and arranged above the casing.

11. Electrostatic coating plant as claimed in claim 1 wherein said support device for the article to be coated is mounted for movement for transporting the article along a predetermined path of travel past said spraying gun, and said coating plant includes an ionizing device located downstream from the treatment area for neutralizing any charge which may still be present on the coated article after the coated article passes downstream from said treatment area.

* * * * *